US005573690A

United States Patent [19]

Nobori et al.

[11] Patent Number: 5,573,690

[45] Date of Patent: Nov. 12, 1996

[54] CERAMIC ARTICLES

[75] Inventors: Kazuhiro Nobori, Haguri-gun; Koichi Umemoto, Toyota; Ryusuke Ushikoshi, Tajimi; Shinji Yamaguchi, Ama-gun, all of Japan

[73] Assignee: NGK Insulators, Ltd., Japan

[21] Appl. No.: 396,139

[22] Filed: Mar. 1, 1995

[30] Foreign Application Priority Data

Mar. 2, 1994 [JP] Japan ..... 6-032230
Feb. 28, 1995 [JP] Japan ..... 7-039816

[51] Int. Cl.[6] ..... H05B 3/74

[52] U.S. Cl. ..... 219/457; 219/459; 219/464; 219/467; 219/544

[58] Field of Search ..... 219/457, 459, 219/464, 544, 467

[56] References Cited

U.S. PATENT DOCUMENTS 1,233,395 7/1917 Putten ..... 219/459
1,905,770 4/1933 Walker et al. ..... 219/464
2,160,227 5/1939 Platt ..... 219/544
4,481,407 11/1984 Stokes et al. ..... 219/464

FOREIGN PATENT DOCUMENTS 4-87179 3/1992 Japan .

*Primary Examiner*—Patrick Ryan
*Assistant Examiner*—Cathy K. Lee
*Attorney, Agent, or Firm*—Parkhurst, Wendel & Burr, L.L.P.

[57] ABSTRACT

Ceramic articles such as ceramic heaters, ceramic static chucks or the like include a substrate 1, a functional member such as a resistance heating element 2 or the like embedded in the substrate 1, a terminal 12 and a conductive wire 5A arranged therebetween. The conductive wire 5A is connected and fixed to the terminal 12, and a connection portion C between the conductive wire 5A and the terminal 12 is continued thereto. Alternatively, a post portion formed on the terminal 12 is extended in a direction crossing to a thickness direction of a plate-like substrate 1, and an end portion of the resistance heating element 2 is wound around the post portion. Alternatively, an end portion of the resistance heating element 2 is connected to the terminal 3 at a center portion in a thickness direction of the plate-like substrate 1.

16 Claims, 9 Drawing Sheets

CERAMIC ARTICLES

BACKGROUND OF THE INVENTION

1. Field of the Invention

The present invention relates to ceramic articles such as ceramic heaters, ceramic static chucks or the like.

2. Related Art Statement

In a field of semiconductor apparatuses such as etching apparatuses, chemical vapor deposition apparatuses, or the like, so-called "stainless heaters" and heaters of indirect heating type have been generally used. However, these heat sources have posed problems such that particles generated by action of halogenous corrosive gases reduce heating efficiency. In order to solve the problems, the inventors proposed a ceramic heater in which a wire made of a metal having a high melting point is embedded in a dense ceramic disc-shaped substrate. This wire is in a spirally-coiled shape within the disc-shaped substrate and connected at both ends thereof with terminals. It has been found that this ceramic heater has excellent characteristics particularly for the manufacture of semiconductors.

In order to manufacture the ceramic heater mentioned above, a wire or filament made of a metal having a high melting point is wound up into a convolution, both ends of which are connected with terminals, respectively. On the other hand, ceramic powders are charged into a press-molding machine and preformed to have a certain extent of hardness. In this case, a continuous recess or groove is provided along a predetermined planar pattern on the surface of the preformed body. Then, the convolution is accommodated in the recess and covered with the ceramic powder. Then, the ceramic powders are subjected to a uniaxial pressure molding to form a disc-shaped molded body which is then sintered by a hot-pressing method.

The reason for making a shape of the ceramic heaters to a disc-shape is as follows. In the known stainless heater, a heating plane for a semiconductor wafer is largely separated from the terminals of a resistance heating element, and a cable for power supply is connected with the terminals at an outer portion from a container of the semiconductor manufacturing apparatus. Generally, a heating plane shows a high temperature and is exposed to a corrosive atmosphere. However, the connection portion between the terminals and the cable does not become a high temperature and also is not exposed to a corrosive atmosphere. On the contrary, in the case of manufacturing the ceramic heaters, since the resistance heating element is arranged in the ceramic powders and is molded, it is necessary to use a simple molded shape such as a disc-shape or the like from a manufacturing point of view. Also in the sintering step, since the molded body is subjected to a hot-press sintering, it is preferred to use a simple molded shape such as a disc-shape or the like. Moreover, a sintered deformation layer as shown by a black portion is generated on a surface of the sintered body after the sintering, and this sintered deformation layer must be removed by a machining operation. In this case, it is necessary to use a diamond whetstone or the like. Therefore, if the shape of the sintered body is complicated, the cost for this machining operation becomes extremely large. In this manner, in the ceramic heater in which the resistance heating element is embedded, it is necessary to use a simple shape such as a disc-shape or the like due to a difficulty on the manufacturing. Therefore, it is very difficult to arrange the terminals of the ceramic heater outside of the container of the semiconductor manufacturing apparatus from the structural point of view. Consequently, in the ceramic heater in which the resistance heating element is embedded, the terminals thereof are inevitably exposed to a corrosive gas having a high temperature.

In order to solve this problem, the applicant disclosed, in Japanese Patent Laid-open Publication No. 4-87,179 (JP-A-4-87,179), a method of connecting the terminals of the ceramic heater with the power supply member in a heat resistive and corrosion resistive manner. In this case, it is necessary to make a diameter of the terminals large and to connect end portions of the resistance heating element with the terminals.

As for the connecting method, there is a method such that the end portions of the resistance heating element are inserted to caulking portions formed at the terminals, and the caulking portions are caulked to fix the end portions to the terminals. FIG. 1 is a partial cross sectional view showing a connection portion between a terminal 12 and a resistance heating element 2 in the ceramic heater mentioned above. In FIG. 1, the resistance heating element 2 is shown by a front view for a convenience of understanding. In this embodiment, the resistance heating element 2 and the terminal 12 are embedded in a disc-shaped substrate 1. Two principal planes 1*a* and 1*b* are arranged to the disc-shaped substrate 1. A main body 12*b* of the terminal 12 has an exposed plane 12*a* exposed to a side of the principal plane 1*b*. Moreover, the resistance heating element 2 is made of a coiled-spring convolution. A numeral 5 shows a respective coil constituting the convolution. A linear portion 30 arranged at an end portion of the coil 5 is inserted into a cylindrical projection portion 12*c* of the terminal 12. The cylindrical projection portion 12*c* is caulked to connect the resistance heating element 2 with the terminal 12 in such a manner that an end portion 13 of the linear portion 30 is inserted in an inner portion 22 of the cylindrical projection portion 12*c*.

SUMMARY OF THE INVENTION

The inventors conducted a further detail investigation about the ceramic heater manufactured by the method mentioned above. As a result, the following problems have been detected. That is to say, use was made of the plate-like substrate 1 made of silicon nitride, and the resistance heating element 2 and the terminal 12, both made of tungsten. Moreover, the end portion of the resistance heating element 2 was caulked to fix. Then, a radiation thermometer was arranged on a side of the heating plane 1*a* of the ceramic heater and a temperature of the heating plane 1*a* was measured.

As a result, hot spots having a diameter of about 7~8 mm were observed locally at portions near the terminal 12. For example, if a temperature of the heating plane 1*a* was set to 800° C., a temperature of the hot spots was about 100° C. higher than a circumferential temperature, and, in an extreme case, the resistance heating element 2 was broken at the hot spot.

The tasks of the present invention are to prevent a generation of the hot spot near the terminal and especially to prevent the broken portion of the resistance heating element near and at the connection portion between a functional member such as resistance heating elements and the terminal, in a ceramic article comprising a substrate made of ceramics, the functional members embedded in the substrate, and the terminals embedded in the substrate and connected with the functional members.

In the ceramic heater mentioned above, the inventors investigated the reason for observing the hot spots having a diameter of about 7~8 mm locally at the portions near the terminal 12. As a result, the inventors have found the following phenomena originally. The phenomena will be explained with reference to FIG. 1.

As mentioned above, in the case of manufacturing the ceramic heater shown in FIG. 1, firstly the terminals 12 are connected with both ends of a resistance heating element 2. Then, the resistance heating element 2 with the terminals 12 at its both end portions is embedded at a predetermined position in ceramic powders of a press-molding machine. After that, the ceramic powders are subjected to a uniaxial pressure molding to form a plate-like molded body which is then sintered by a hot-pressing method.

In the method mentioned above, especially in the case of pressing the ceramic powders and reacting by the hot-pressing method, the ceramic powders are largely flowed. In this case, at the end portion of the resistant heating element 2, an end portion D of the coil 5 is positioned at a substantially center portion in a thickness direction of the disc-shaped substrate 1. Moreover, a connection portion C between the cylindrical projection portion 12*c* and the resistance heating element 2 is positioned at a portion near the rear plane 1*b* as compared with the position D. A region between the position C and the position D is the linear portion 30 for connecting the coil 5 with the terminal 12.

In this case, if the hot-pressing is performed, a positional deviation due to the flow of the ceramic powders is small at a portion neighboring the position D. Since the substrate 1 is compressed in a thickness direction due to a pressure applied in the thickness direction of the substrate 1, positions of the principle planes 1*a* and 1*b* are largely deviated, but a center position in the thickness direction is not so deviated. On the contrary, since the terminal 12 is largely deviated in this case, the position C is also largely deviated. Particularly, the terminal 12 is liable to be inclined with respect to the initial position.

As a result, a tensile pressure is applied to the linear portion 30 arranged between the position C and the position D. The resistance heating element made of the metal having a high melting point becomes very brittle in a high temperature condition during the hot-pressing operation. Therefore, the resistance heating element does not endure the tensile pressure, thereby generating abnormal heat due to an increase of the resistivity or generation of a wire break. These problems also occur in the case of sintering by a hot isostatic pressing method.

The inventors examined the case such that an effect of the tensile pressure applied to the resistance heating element is reduced by increasing a diameter of the resistance heating element 2. For example, in the case of using tungsten as the resistance heating element, if a sintering temperature is elevated to about 1800° C., it becomes very brittle. Therefore, if the tensile pressure is applied thereto, the resistance heating element is easily broken even if a diameter of the resistance heating element is increased.

Then, the inventors thought that a curved portion is arranged between the connection portion mentioned above and the resistance heating element and the curved portion is continuously drawn from the connection portion. That is to say, the inventors tried to manufacture the ceramic heater in the case that substantially no linear portion is arranged between the curved portion and the connection portion. As a result, it is found that the curved portion absorbs the deviation of the position C at the connection portion by its deformation, even if a distance between the position C and the position D becomes large, i.e. even if the terminal is deviated due to the flow of the ceramic powders or inclined with respect to the initial position during the hot-pressing operation or the hot isostatic pressing operation. Therefore, generation of abnormal heat or breaking of the wire does not occur in the region between the resistance heating element and the terminal.

Moreover, in the embodiment shown in FIG. 1, the resistance heating element is embedded in the substrate. The inventors tried to manufacture the ceramic heater in such a manner that various functional members are embedded in the substrate instead of the resistance heating element, and a curved conductive wire is arranged between the functional member and the terminal as is the same as the resistance heating element. Also in this case, it is found that the same effects can be obtained as is the same as the resistance heating element. Therefore, the first embodiment of the present invention can be adapted to the ceramic articles in which various kinds of functional members are embedded in the substrate.

Further, the inventors tried to form a linear portion between the curved portion and the connection portion, while the curved portion is arranged between, the connection portion arranged between the conductive wire and the terminal, and the functional member. Then, to which extent the linear portion is allowable was investigated. Consequently, it was found that the same effects of the tensile pressure reduction as those of the embodiment mentioned above can be obtained, if a diameter of the curved portion is larger than a length of the linear portion.

Therefore, according to the first embodiment of the present invention, a ceramic article having a substrate made of ceramics, a functional member embedded in the substrate, a terminal embedded in the substrate and a conductive wire continued to the functional member, is characterized in that the conductive wire is connected to the terminal, and the curved portion is at least arranged between the connection of portion for connection the conductive wire and the terminal and the functional member.

In the first embodiment mentioned above, it is particularly preferred from the view of the pressure reduction that the curved portion is continuously drawn from the connection portion for connecting the conductive wire and the terminal. Moreover, in this case, since the connection portion and the curved portion are continued, substantially no linear portion exists between them.

Moreover, after further investigations, the inventors found it preferable that the curved portion is formed on a center axis of the terminal so as to effectively reduce the tensile pressure generated by the terminal inclination due to the flow of the ceramic powders. In this case, when the terminal is inclined with respect to the initial position, the curved portion is rapidly deformed and it is easy to reduce the pressure.

Therefore, according to the second embodiment of the present invention, a ceramic article having a substrate made of ceramics, a functional member embedded in the substrate, a terminal embedded in the substrate and a conductive wire continued to the functional member, is characterized in that the conductive wire is connected to the terminal, and the curved portion is at least arranged between the connection portion for connecting the conductive wire and the terminal and the functional member in such a manner that the curved portion is formed on a center axis of a portion of the terminal where the conductive wire is brought into contact.

In the first and second embodiments of the present invention, a shape of the curved portion is not limited, but it is particularly preferred to use a spirally-coiled convolution. In this case, it is not necessary to use the convolution having a spirally-coiled portion by one turn, but the effect of the present embodiment can be achieved by the convolution having a spirally-coiled portion by, for example, a half turn.

Moreover, a connection method between the conductive wire and the terminal is not limited, but the use of the following methods is preferred.

The conductive wire is secured to the terminal by the caulking method.

A post portion is formed on the terminal, and the conductive wire is wound around the post portion.

A winding member is formed on the terminal, the conductive wire is wound around the winding member, and the winding member is fitted in a securing member.

The conductive wire is wound, a male screw is formed on the terminal in such a manner that a winding direction of the male screw is identical with that of the wounded conductive wire, and the wounded conductive wire is arranged in a root portion of the male screw.

Use is made of chemical methods such as a welding method, a solid phase connection method or the like.

Moreover, the inventors tried to manufacture the ceramic heater in such a manner that a post portion extending in a direction crossing to the thickness direction of the plate-like substrate is formed on the terminal, and the conductive wire is wound around the post portion. As a result, since an extending direction of the conductive wire from the connection portion for connecting the conductive wire and the terminal is crossed to the thickness direction of the plate-like substrate, the connection portion is not deviated in the thickness direction of the plate-like substrate. Therefore, the tensile pressure mentioned above can be reduced, and a temperature increase at or near the connection portion becomes small. In the second embodiment of the present invention, since the conductive wire is brought into contact with the post portion, the curved portion is formed on a center axis of the post portion.

Therefore, according to the third embodiment of the present invention, a ceramic article having a plate-like substrate made of ceramics, a functional member embedded in the plate-like substrate, a terminal embedded in the plate-like substrate and a conductive wire continued to the functional member, is characterized in that a post portion extending in a direction crossing to the thickness direction of the plate-like substrate is formed on the terminal, and the conductive wire is wound around the post portion.

In this case, it is particularly preferred to extend the post portion in a direction perpendicular to the thickness direction of the plate-like substrate, but the effect of the present invention can be achieved even if the post portion is inclined within 45° with respect to the direction perpendicular to the thickness direction of the plate-like substrate.

In the third embodiment of the present invention, a shape of the post portion is not limited, but it is preferred to use the post portion having a cross section of a circle or a regular polygon such as a square, a hexagon or the like. Moreover, a surface of the post portion may be smooth. On the contrary, the male screw may be formed on the surface of the post portion. In this case, the conductive wire is wound, the male screw is formed on the surface of the post portion in such a manner that the winding direction of the male screw is identical with that of the wound conductive wire, and the wound conductive wire is arranged in the root of the male screw. An effect of the connection mentioned above will be explained below.

Moreover, all the conductive wire may be formed by a linear shape. Further, a part of or all of the conductive wire may be formed by the curved portion. A shape of the curved portion is not limited, but it is particularly preferred to use the spirally-coiled convolution as the curved portion. This is because, when a position of the connection portion for connecting the conductive wire and the terminal is slightly deviated, the convolution can be easily deformed, thereby reducing the tensile pressure. Also in this case, it is not necessary to use the convolution having a spirally-coiled portion by one turn, but the effect of the present embodiment can be achieved by the convolution having spirally-coiled portion by, for example, a half turn.

In the case of arranging the curved portion in the conductive wire, it is preferred to set a curvature diameter of the curved portion larger than a length of the linear portion. From the view point of the pressure reduction, it is particularly preferred that the curved portion is continuously drawn from the connection portion for connecting the conductive wire and the terminal. In this case, since the connection portion and the curved portion are continued, substantially no linear portion exists therebetween. Moreover, it is preferred to form the curved portion on a center axis of the terminal.

Further, if the substrate is a plate-like substrate, it is preferred to connect the conductive wire to the terminal at the center portion in the thickness direction of the plate-like substrate. In this case, a positional deviation of the connection portion can be reduced much more. Moreover, a thin metal wire having a diameter smaller than that of the conductive wire may be wound around the conductive wire.

Further, the inventors thought that the conductive wire should be connected to the terminal at the center portion in the thickness direction of the plate-like substrate. As a result, since the ceramic powders do not flow as much at the center portion of the plate-like substrate, a position of the connection portion is not deviated in the thickness direction of the plate-like substrate. Consequently, the tensile pressure can be reduced and the temperature increase at or near the connection portion can be reduced also.

Therefore, according to the fourth embodiment of the present invention, a ceramic article having a plate-like substrate made of ceramics, a functional member embedded in the plate-like substrate, a terminal embedded in the plate-like substrate and a conductive wire continued to the functional member, is characterized in that the conductive wire is connected to the terminal at the center portion in the thickness direction of the plate-like substrate.

In the fourth embodiment according to the present invention, all the conductive wire may be formed by a linear shape. Further, from the view point of the tensile pressure reduction, it is preferred that a part of or all of the conductive wire is formed by the curved portion. A shape of the curved-portion is not limited, but it is particularly preferred to use the spirally-coiled convolution as the curved portion. This is because, when a position of the connection portion for connecting the conductive wire and the terminal is slightly deviated, the convolution can be easily deformed, thereby reducing the tensile pressure. Also in this case, it is not necessary to use the convolution having a spirally-coiled portion by one turn, but the effect of the present embodiment can be achieved by the convolution having a spirally-coiled portion by one turn, but the effect of the present embodiment can be achieved by the convolution having a spirally-coiled portion by, for example, a half turn.

In the case of arranging the curved portion in the conductive wire, it is preferred to set a curvature diameter of the curved portion larger than a length of the linear portion. From the view point of the pressure reduction, it is particularly preferred that the curved portion is continuously drawn from the connection portion for connecting the conductive wire and the terminal. In this case, since the connection portion and the curved portion are continued, substantially no linear portion exists therebetween. Moreover, it is preferred to form the curved portion on a center axis of the terminal.

Further, a thin metal wire having a diameter smaller than that of the conductive wire may be wound around the conductive wire.

In the fourth embodiment according to the invention, a connection method between the conductive wire and the terminal is not limited, but the use of the following methods is preferred.

The conductive wire is secured to the terminal by the caulking method.

A post portion is formed on the terminal, and the conductive wire is wound around the post portion.

A winding member is formed on the terminal, the conductive wire is wound around the winding member, and the winding member is fitted in a securing member.

The conductive wire is wound, a male screw is formed on the terminal in such a manner that a winding direction of the male screw is identical with that of the wounded conductive wire, and the wounded conductive wire is arranged in a root portion of the main screw.

Use is made of chemical methods such as a welding method, a solid phase connection method or the like.

Moreover, the inventors tried to arrange the other metal member around the conductive wire. In this case, when the tensile pressure is applied to the conductive wire due to a positional deviation of the connection portion for connecting the conductive wire and the terminal, a part of the tensile pressure is reduced by an elasticity or a plasticity of the metal member.

Therefore, according to the fifth embodiment of the present invention, a ceramic article having a substrate made of ceramics, a functional member embedded in the substrate, a terminal embedded in the substrate and a conductive wire continued to the functional member, is characterized in that the conductive wire is connected to the terminal, and a metal member is arranged around the conductive wire.

In this embodiment, as for the metal member, it is preferred that use is made of a thin metal wire having a diameter smaller than that of the conductive wire, and the thin metal is wound around the conductive wire. In this case, a pressure reduction due to an elasticity of the metal wire is achieved remarkably. Further, if the conductive wire is broken by a positional deviation of the connection portion for connecting the conductive wire and the terminal, the metal wire wound around the conductive wire is not broken. Therefore, an electric current can be flowed through the metal wire. In this case, it is possible to prevent a generation of broken wire or a generation of abnormal heat at this portion.

Further, in the fifth embodiment according to the present invention, use may be made of a pressure reduction member such as a wire member, a plate member, a foil member or the like, each of which is made of a metal, and the pressure reduction member may be arranged to the connection portion for connecting the conductive wire and the terminal in such a manner that a portion near the connection portion is covered by the pressure reduction member. In this case, the pressure reduction member functions to prevent flow of the ceramic powders near the connection portion for connecting the conductive wire and the terminal i.e. a generation of the tensile pressure during the sintering step, and thus the tensile pressure can be reduced.

Moreover, all the conductive wire may be formed by a linear shape. Further, from the view point of the tensile pressure reduction, it is preferred that a part of or all of the conductive wire may be formed by the curved portion. A shape of the curved portion is not limited, but it is particularly preferred to use the spirally-coiled convolution as the curved portion. This is because, when a position of the connection portion for connecting the conductive wire and the terminal is slightly deviated, the convolution can be easily deformed. Also in this case, it is not necessary to use the convolution having a spirally-coiled portion by one turn, but the effect of the present embodiment can be achieved by the convolution having a spirally-coiled portion by, for example, a half turn.

In the case of arranging the curved portion in the conductive wire, it is preferred to set a curvature diameter of the curved portion larger than a length of the linear portion. From the view point of the present reduction, it is particularly preferred that the curved portion is continuously drawn from the connection portion for connecting the conductive wire and the terminal. In this case, since the connection portion and the curved portion are continued, substantially no linear portion exists therebetween. Moreover, it is preferred to from the curved portion on a center axis of the terminal.

Further, if the substrate is a plate-like substrate, it is preferred to connect the conductive wire to the terminal at the center portion in the thickness direction of the plate-like substrate. In this case, a positional deviation of the connection portion can be reduced much more.

In the fifth embodiment according to the invention, a connection method between the conductive wire and the terminal is not limited, but the use of the following methods is preferred.

The conductive wire is secured to the terminal by the caulking method.

A post portion is formed on the terminal, and the conductive wire is wound around the post portion. In this case, it is preferred to extend the post portion in a direction crossing particularly perpendicular to the thickness direction of the plate-like substrate and to wind the conductive wire around the extended post portion.

A winding member is formed on the terminal, the conductive wire is wound around the winding member, and the winding member is fitted in a securing member.

The conductive wire is wound, a male screw is formed on the terminal in such a manner that a winding direction of the male screw is identical with that of the wounded conductive wire, and the wounded conductive wire is arranged in a root portion of the male screw.

Use is made of chemical methods such as a welding method, a solid phase connection method or the like.

Moreover, the inventors tried the case such that the conductive wire is wound, the male screw is formed on the terminal and the wounded conductive wire is arranged in a root portion of the male screw. In this case, since the winding direction of the male screw is identical with that of the wounded conductive wire, a slight space or clearance exists between the conductive wire and the root portion of the male screw when the wounded conductive wire is arranged in a root portion. However, if the conductive wire is pulled, no space or clearance exists between the conductive wire and the root portion of the male screw, thereby connecting strongly the conductive wire with the male screw. Therefore, it is possible to connect the conductive wire strongly with the terminal by an extremely easy operation.

Therefore, according to the sixth embodiment of the present invention, a ceramic article having a substrate made of ceramics, a functional member embedded in the substrate, a terminal embedded in the substrate and a conductive wire continued to the functional member, is characterized in that the male screw is formed on the terminal, and the conductive wire is wound around the terminal in such a manner that the conductive wire is arranged in the root portion of the male screw. In this case, a linear end portion of the conductive wire can be successively accommodated along the root portion of the male screw. Further, it is possible to connect the conductive wire with the terminal by winding an end portion of the conductive wire beforehand, the winding direction of which is identical with that of the male screw, and arranging the wound conductive wire in the root portion of the male screw.

In the sixth embodiment according to the invention, all the conductive wire between the connection portion and the functional member may be formed by a linear portion. From the view point of the tensile pressure reduction, it is preferred that a part of or all of the conductive wire between the connection portion and the functional member is formed by a curved portion. A shape of the curved portion is not limited, but it is preferred to use a spirally-coiled convolution as the curved portion. Also in this case, it is not necessary to use the convolution having a spirally-coiled portion by one turn, but the effect of the present embodiment can be achieved by the convolution having the spirally-coiled portion by, for example, a half turn.

In the case of arranging the curved portion in the conductive wire, it is preferred to set a curvature diameter of the curved portion larger than a length of the linear portion. From the view point of the pressure reduction, it is particularly preferred that the curved portion is continuously drawn from the connection portion for connecting the conductive wire and the terminal. In this case, since the connection portion and the curved portion are continued, substantially no linear portion exists therebetween. Moreover, it is preferred to form the curved portion on a center axis of the terminal.

Further, if the substrate is a plate-like substrate, it is preferred to connect the conductive wire to the terminal at the center portion in the thickness direction of the plate-like substrate. In this case, a positional deviation of the connection portion can be reduced much more. Moreover, a thin metal wire having a diameter smaller than that of the conductive wire may be wound around the conductive wire.

Furthermore, a post portion extending in a direction crossing to the thickness direction of the plate-like substrate may be formed on the terminal, and the male screw may be formed on a surface of the post portion. Also in this case, the conductive wire is wound around the post portion in such a manner that the conductive wire is arranged in the root portion of the male screw.

In this case, it is particularly preferred to extend the post portion in a direction perpendicular to the thickness direction of the plate-like substrate, but the effect of the present invention can be achieved even if the post portion is inclined within 45° with respect to the direction perpendicular to the thickness direction of the plate-like substrate. A shape of the post portion is not limited, but is preferred to use the post portion having a cross section of a circle or a regular polygon such as a square, a hexagon or the like.

According to the seventh embodiment of the present invention, a ceramic article having a plate-like substrate, a functional member embedded in the plate-like substrate, a terminal embedded in the plate-like substrate and a conductive wire continued to the functional member, is characterized in that a winding member is formed on the terminal, the conductive wire is wound around the winding member and the winding member is fitted in a securing member. In this case, an end portion of the conductive wire is supported certainly and thus it is not fared that the end portion is left from the terminal.

As for the winding member, it is preferred to use the male screw. As for the securing member, it is preferred to use an internal thread. In this case, only if the winding member can be wound by the conductive wire, the winding member may be formed by a projection having no male screw. Moreover, only if the securing member can secure the conductive wire wound around the winding member, the securing member may have no internal thread portion. A shape of the winding member is not limited, but it is preferred to use the winding member having a cross section of a circle or a regular polygon such as a square, a hexagon or the like.

In the seventh embodiment according to the invention, it is possible to form a curved portion between the connection portion and the functional member. A shape of the curved portion is not limited, but it is preferred to use a spirally-coiled convolution as the curved portion. Also in this case, it is not necessary to use the convolution having a spirally-coiled portion by one turn, but the effect of the tensile pressure reduction can be achieved by the convolution having the spirally-coiled portion by, for example, a half turn.

In the case of arranging the curved portion in the conductive wire, it is preferred to set a curvature diameter of the curved portion larger than a length of the linear portion. From the view point of the pressure reduction, it is particularly preferred that the curved portion is continuously drawn from the connection portion for connecting the conductive wire and the terminal. In this case, since the connection portion and the curved portion are continued, substantially no linear portion exists therebetween. Moreover, it is preferred to form the curved portion on a center axis of the terminal.

Further, if the substrate is a plate-like substrate, it is preferred to connect the conductive wire to the terminal at the center portion in the thickness direction of the plate-like substrate. In this case, a positional deviation of the connection portion can be reduced much more. Moreover, a thin metal wire having a diameter smaller than that of the conductive wire may be wound around the conductive wire.

DESCRIPTION OF THE PREFERRED EMBODIMENTS

Figure 1:
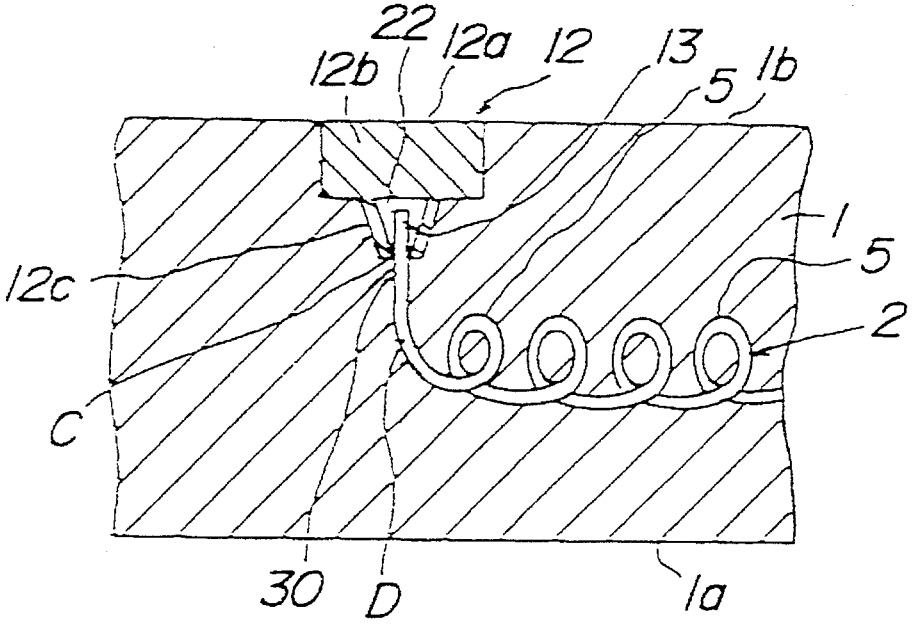
FIG 1 PRIOR ART
FIG. 1 is a cross sectional view showing a portion neighboring a terminal 12 of a ceramic heater according to a comparative example.

In the first to seventh embodiments of the present invention, as for a material of a ceramic substrate, it is preferred to use a ceramic of a nitride system such as silicon nitride, sialon, aluminum nitride or the like. It is particularly preferred to use silicon nitride or sialon from the view point of a heat resistivity. Aluminum nitride shows an excellent corrosion resistivity with respect to a corrosion gas of fluorine system such as $NF_3$ or the like.

As for a material of a terminal or a power supply member to be connected electrically to the terminal, it is preferred to use a metal having a high melting point such as tungsten, molybdenum, platinum, nickel or the like. Moreover, it is also preferred to use an alloy of the metals mentioned above. In the case of using a plate-like substrate, a planar shape of the plate-like substrate may be a circle, a cylinder, a square, a rectangle, a hexagon or the like.

As for a functional member, a resistance heating member may be used. A shape of the resistance heating member itself may be a wire shape, a plate shape or a foil shape. As for the resistance heating member, it is preferred to use a coil spring (spirally-coiled) convolution. In this case, a shape of the spirally-coiled convolution viewed along a center axis thereof may be a circle, a triangle, a square or the like. As for a material of the resistance heating element, it is preferred to use a metal having a high melting point such as tungsten, molybdenum, platinum nickel and so on or the alloy of them.

Moreover, the present invention can be adapted to a connection portion between an embedded electrode and a terminal in an electrode device for generating a plasma. The electrode device for generating a plasma will be explained.

Method (1): A preformed body is manufactured, and a high frequency electrode is arranged on the preformed body. Then, ceramic powders are charged on the preformed body and the electrode, and a uniaxial pressure is applied thereto to obtain a formed body. Then, the formed body is subjected to a hot press sintering while a pressure is applied to high frequency electrode along a thickness direction thereof.

Method (2): A pair of plate-like substrates are formed by a cold isostatic press method, and a high frequency electrode is sandwiched between a pair of plate-like substrates. Then, the plate-like substrates and the high frequency electrode are subjected to a hot press sintering while a pressure is applied to the high frequency electrode along a thickness direction thereof.

As for the high frequency electrode, a temperature of which is elevated above 600° C., use may be made of a metal having a high melting point. As for the metal having a high melting point, it is preferred to use tantalum, tungsten, molybdenum, platinum, rhenium, hafnium or the alloy thereof. In the case of using it in a semiconductor manufacturing device, it is preferred to use tantalum, tungsten, molybdenum, platinum or the alloy thereof from the view point of an elimination of semiconductor contaminations.

A shape of the electrode may be a plate-like electrode made of a thin plate or a plate-like electrode having a plurality of small holes. In the case of using the plate-like electrode having a plurality of small holes, since the ceramic powders are flowed into the small holes, a connection strength of ceramic members arranged on both sides of the plate-like electrode becomes larger and thus it is possible to increase a strength of the substrate.

As for the plate-like electrode mentioned above, use may be made of a punching metal or a wire net. In the case of using the electrode constituted by the punching metal made of a metal having a high melting point, since a hardness of the metal is very high, it is difficult to form a plurality of small holes in the plate-like electrode and thus a working cost becomes very expensive.

On the contrary, in the case of using the electrode made of the wire net, since the wire made of a metal having a high melting point can be purchased on a market, it is easy to form the electrode by netting the wire.

Moreover, in the case of using the electrode made of the thin plate, since a large pressure is generated particularly at a peripheral portion of the electrode due to a difference of thermal expansion coefficients between the electrode and the substrate, the substrate is liable to be fractured by this pressure. On the other hand, if use is made of the electrode having a plurality of small holes, the pressure mentioned above can be dispersed by the small holes. Moreover, in the case of using a wire net electrode, since the wire net has a circular cross section, an effect of the pressure dispersion can be largely improved.

In this case, a mesh shape, a diameter of the wire net and so on of the wire net electrode are not particularly limited. However, it is preferred to use the wire net electrode having a wire width of smaller than 0.8 mm and more than eight cross points per 1 inch. In this case, if the wire width of the wire net electrode is not less than 0.8 mm, a distribution of an electric field strength is varied in a space for generating a plasma constituted between the wire net electrode and an opposed electrode, and thus a plasma distribution is liable to be worse. Moreover, when the electrode device for generating a plasma is used for a long time, a level of a pressure field generated due to the wire net existing in the ceramic substrate as an abnormal substance becomes more than a strength of the ceramic substrate, and thus the ceramic substrate is liable to be fractured. Further, if the number of the cross points per 1 inch is not more than 8, a uniform current is not flowed in the wire net electrode.

From the view point of an actual manufacturing, it is preferred to set a wire width of the wire net electrode to more than 0.1 mm, and also it is preferred to set the number of the cross sections per 1 inch to less than 100. A cross section of the wire in a width direction constituting the wire net electrode may be a circle, an ellipse, a rectangle or the like or may be various rolled shapes.

In the present invention, an embedded electrode and a terminal of the electrode device for generating a plasma are connected by a conductive wire.

In the first to seventh embodiments according to the invention, when a curved portion is formed in the conductive wire between the connection portion for connecting the conductive wire and the terminal and the functional member, it is preferred to use the coil spring (spirally-coiled) convolution as the curved portion. In this case, it is not necessary to use the curved portion having a circular winding shape. For example, it is possible to use the curved portion having a triangular wave shape, a rectangular wave shape or the like, since they have also a sufficiently same effect as that of the circular curved portion.

Hereinafter, the present invention will be explained in detail with reference to the drawings.

Figure 2:
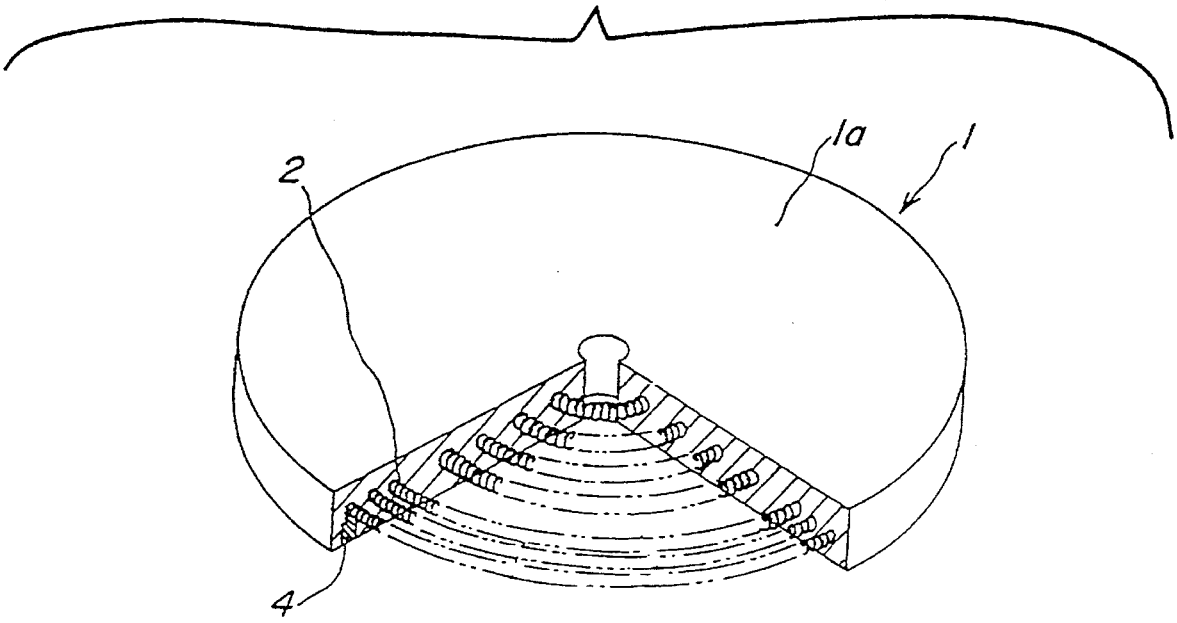
FIG. 2 is a perspective view with a partial cut out portion illustrating a portion neighboring a terminal 4 of a ceramic heater according to an embodiment of the present invention.
Figure 2:
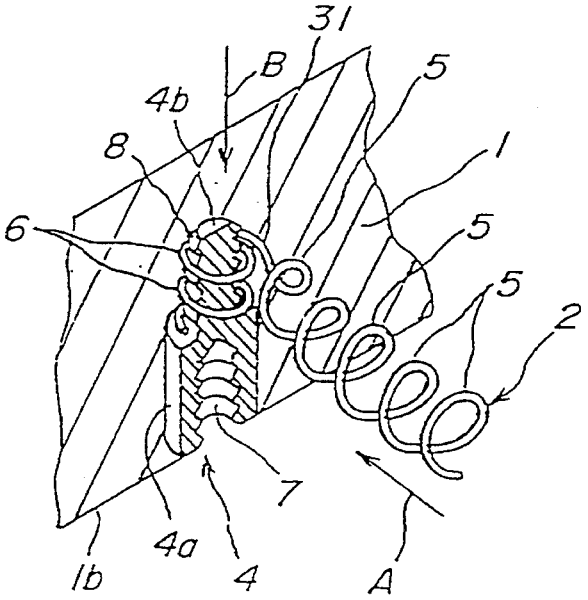
Figure 3A:
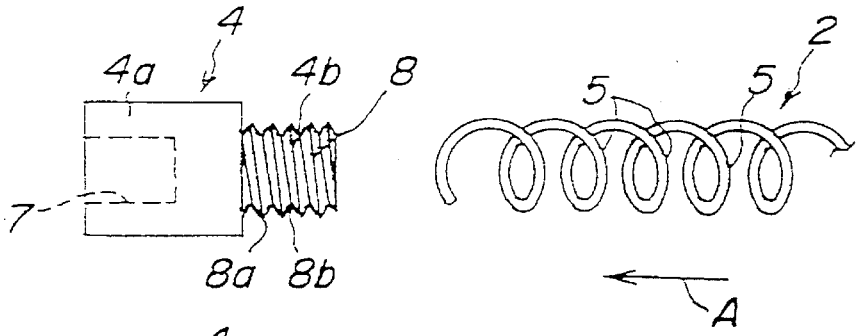
FIG. 3*a* is a front view showing a condition prior to connect a resistance heating element 2 to the terminal 4.
Figure 3B:
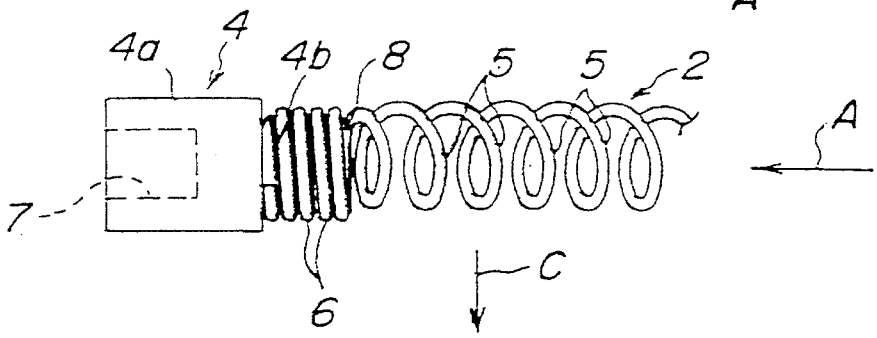
FIG. 3*b* is a front view illustrating a condition such that an end portion of the resistance heating element 2 is wound with respect to a root portion of a male screw formed on the terminal.
Figure 4A:
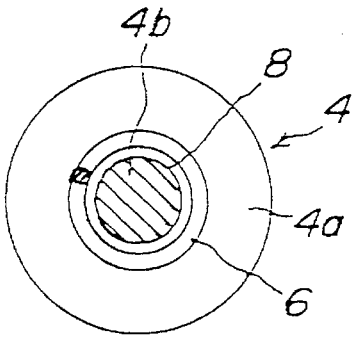
FIG. 4*a* is a plan view showing a condition viewed from a side of the male screw of the terminal 4 such that the end portion of the resistance heating element 2 is wound with respect to the root portion of the male screw formed on the terminal.
Figure 4B:
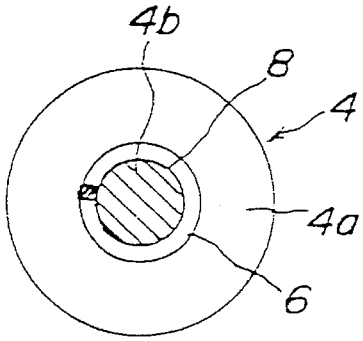
FIG. 4*b* is a plan view illustrating a condition viewed from a side of the male screw of the terminal 4 such that the end portion of the resistance heating element 2 is fastened.

FIGS. 2 to 4 relate to the first embodiment, the second embodiment and the sixth embodiment. FIG. 2 is a perspective view with a cut out portion for showing an inner constitution of a disc-shaped substrate 1. FIG. 3*a* is a front view illustrating a condition prior to connection of a resistance heating element 2 to a terminal 4. FIG. 3*b* is a front view depicting a condition for winding an end portion of the resistance heating element 2 around the terminal in such a manner that the end portion is arranged in a root portion of a male screw of the terminal. FIG. 4*a* is a plan view showing a condition viewed from a side of a male screw 8 of a terminal 4 such that an end portion of the resistance heating element 2 is wound with respect to the root portion of the male screw of the terminal. FIG. 4*b* is a plan view illustrating a condition viewed from a side of the male screw 8 of the terminal 4 such that an end portion of the resistance heating element 2 is fastened.

In the disc-shaped substrate 1, the resistance heating element 2 and the terminal 4 are embedded. On the disc-shaped substrate 1, two principal planes 1*a* and 1*b* are arranged. A main body 4*a* of the terminal 4 has a surface exposed to a side of a rear surface 1*b*. In a side of the exposed surface of the main body 4*a*, an internal thread 7 is formed. A projection 4*b* having a diameter smaller than that of the main body 4*a* is extended from the main body 4*a*. A male screw 8 is formed around the projection 4*b*. A numeral 8*a* is a top portion of the male screw 8, and a numeral 8*b* is a root portion of the male screw 8. In FIG. 3*a*, if viewed from an arrow A direction, the resistance heating element 2 is wound in a clockwise direction, and also the top portion and the root portion of the male screw 8 are formed in a clockwise direction.

Then, as shown in FIG. 3*b*, an end portion of the resistance heating element 2 is accommodated in the root portion 8*b*. In this embodiment, a numeral 6 shows a wound end portion in the root portion 8*b* (although root portion 8*b* cannot be seen in FIG. 3*b* due to the presence of end portion 6). In this case, as shown in FIG. 4*a*, a slight space exists between the end portion of the resistance heating element 2 and the male screw 8.

Then, if the resistance heating element 2 is further rotated in a clockwise direction viewed from the arrow A direction i.e. in the same direction as that of the male screw 8, the end portion of the resistance heating element is fastened with respect to the male screw 8. Then, as shown in FIG. 4*b*, a generation of the space between the wound end portion 6 and the root portion 8*b* of the male screw 8 can be eliminated. After that, in FIG. 3*b*, a power is applied to the resistance heating element 2 in a direction shown by an arrow C, and the resistance heating element 2 is bent. In this case, the resistance heating element 2 is bent to an extent substantially perpendicular to the conductive wire 6 as shown in FIG. 2. Under such a condition, the conductive wire 6 is strongly fastened to the male screw 8, and thus a center axis direction of the resistance heating element 2 shown by an arrow A is substantially perpendicular to a center axis direction of the conductive wire 6 shown by an arrow B. In this case, a curved conductive wire 31 remains between the resistance heating element 2 and the conductive wire 6.

As shown in FIG. 2, the terminal 4 and the resistance heating element 2 are embedded in the disc-shaped substrate 1. In FIG. 2, only one terminal 4 is shown, but it is a matter of course that two or more than two terminals 4 may be arranged. Moreover, in FIG. 2, a position of the resistance heating element 2 is illustrated by a fictitious line for convenience sake. The resistance heating element 2 is embedded in the disc-shaped substrate 1 in a substantially spiral manner as shown by a plan view. In this case, a linear portion may be arranged in the end portion of the conductive wire, and the linear portion may be successively accommodated in the root portion of the male screw.

Figure 5A:
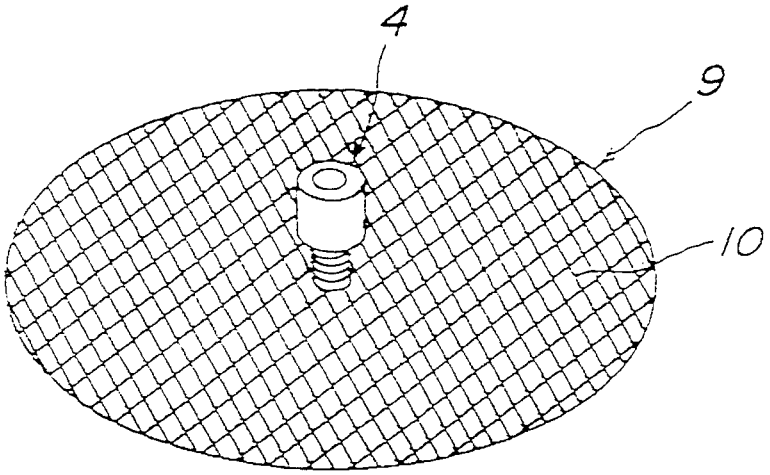
FIG. 5*a* is a perspective view showing one embodiment of the terminal 4 and a net electrode 9.
Figure 5B:
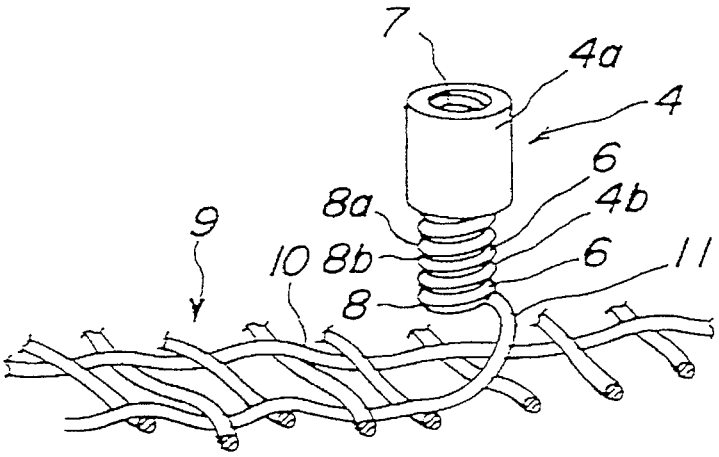
FIG. 5*b* is a perspective view illustrating a condition such that the net electrode 9 is connected with the terminal 4.
Figure 6:
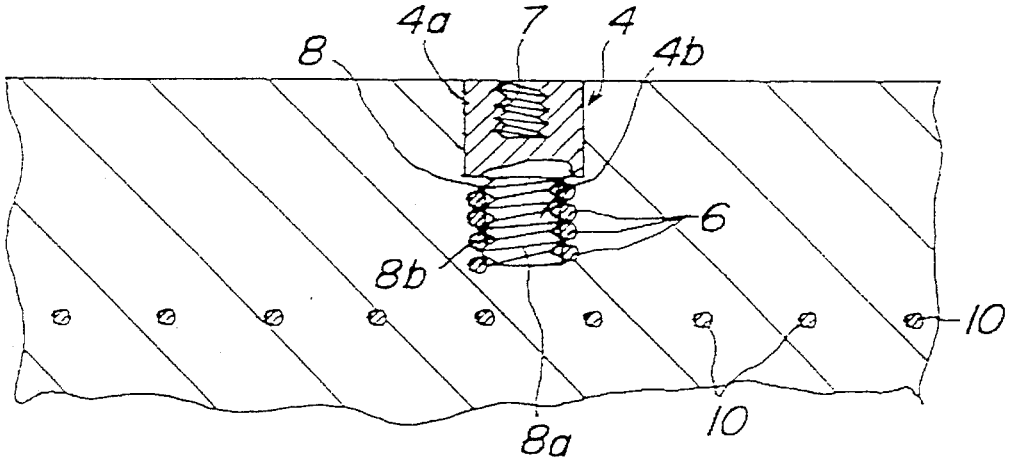
FIG. 6 is a cross sectional view showing a portion neighboring the terminal 4 of an electrode device for generating a plasma.

FIGS. 5*a*, 5*b* and 6 show the sixth embodiment according to the invention.

FIG. 5*a* is a perspective view showing a wire net electrode 9 used for an electrode for generating a plasma and the terminal 4. The wire net electrode 9 is made of thin metal wires 10 netted in a lengthwise and crosswise direction. The netting method of the metal wire 10 may be varied. As shown in FIG. 5*b* and FIG. 6, one conductive wire 11 is drawn from the wire net electrode 9. Then, an end portion of the conductive wire 11 is wound with respect to the root portion 8*b* of the male screw 8 of the terminal 4, and an end portion 6 of the conductive wire is fastened with respect to the male screw 8 by rotating the conductive wire 11 in a screw direction of the male screw 8. Under such a condition, the end convolution portion 6 of the conductive wire 11 is strongly connected to the root portion 8*b* with no space therebetween.

Figure 7A:
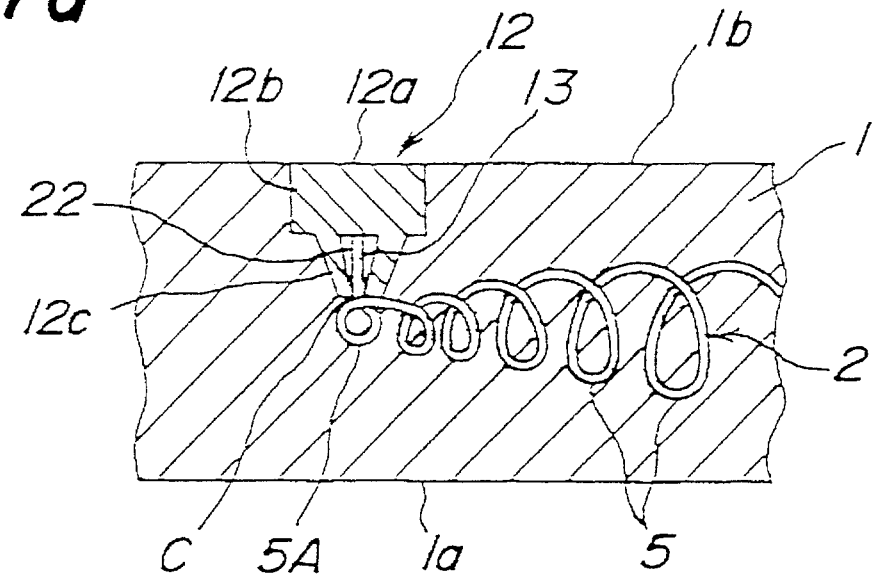
FIG. 7*a* is a cross sectional view illustrating a portion neighboring a terminal 12 of the ceramic heater according to one embodiment of the present invention.
Figure 7B:
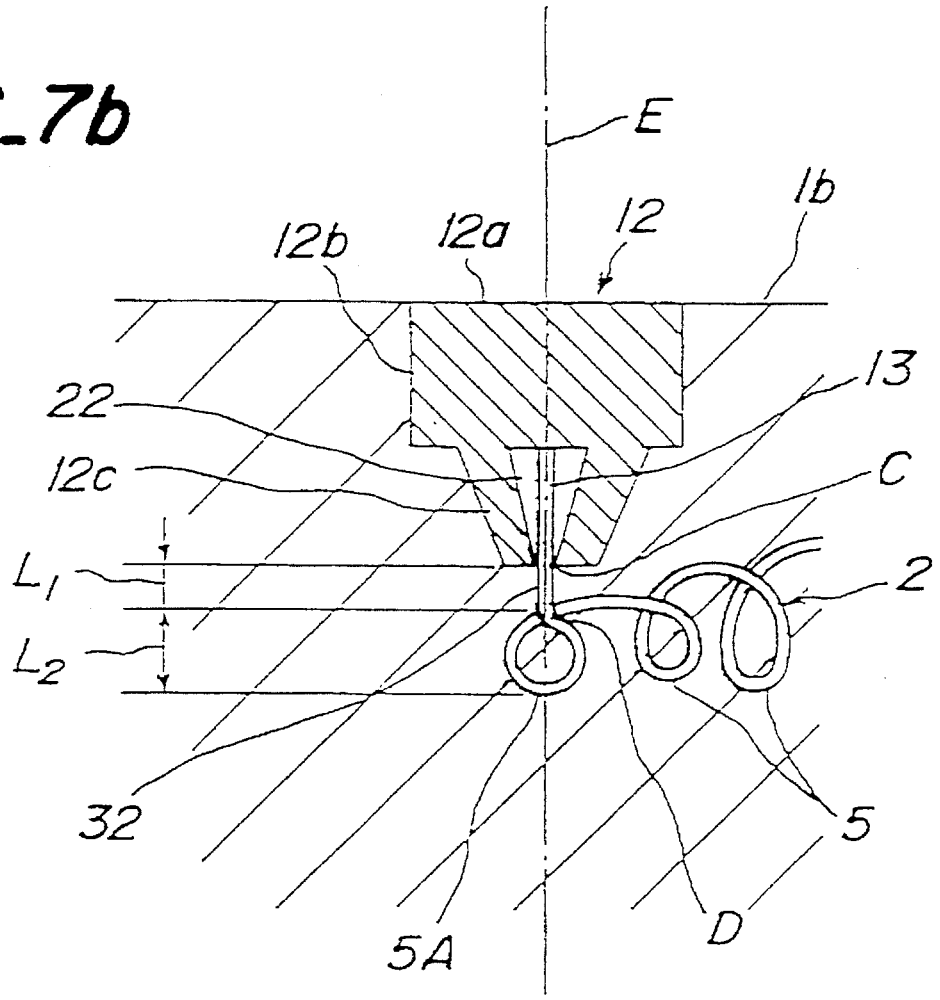
FIG. 7*b* is a cross sectional view showing a portion neighboring the terminal 12 of the ceramic heater according to the other embodiment of the present invention.

FIGS. 7*a* and 7*b* relate to the first and second embodiments according to the invention.

FIG. 7*a* is a cross sectional view showing a portion neighboring a terminal 12. The resistance heating element 2 and the terminal 12 are embedded in the plate-like substrate 1. On the plate-like substrate 1, two principal planes 1*a* and 1*b* are arranged. A main body 12*b* of the terminal 12 has a surface exposed to a side of the principal plane 1*b*. In this embodiment, the resistance heating element 2 is a coil spring convolution 5. A conductive wire 5A is continued from an end portion of the convolution 5, and an end portion of the conductive wire 5A is inserted in a cylindrical projection portion 12*c* of the terminal 12. The cylindrical projection portion 12*c* is deformed by a caulking to connect an end portion 13 in an inner portion 22 of the cylindrical projection portion 12*c*.

The end portion 13 of the conductive wire is continued from the convolution 5A, and substantially no linear portion exists. That is to say, the convolution 5A is directly drawn from a position C of the connection portion between the conductive wire and the terminal 12. Moreover, the convolution 5A is arranged on a center axis of the terminal 12. Therefore, if the position C of the connection portion between the resistance heating element 2 and the terminal 12 is deviated during the hot pressing or the like, the convolution 5A is deformed, thereby absorbing a deviation of the connection portion. In this manner, it is possible to prevent a broken line near the terminal 12 and also prevent generation of abnormal heat.

In the embodiment shown in FIG. 7*b*, a linear portion 32 exists between the end portion 13 of the conductive wire and the convolution 5A, and the linear portion 32 and the convolution 5A are continued. In this case, if it is assumed that a length of the linear portion 32 between the position C of the connection portion for connecting the conductive wire and the terminal 12 and a position D of a boundary between the convolution 5A and the linear portion 32 is $L_1$ and that a curvature diameter of the convolution 5A is $L_2$, $L_2$ is larger than $L_1$. Moreover, the convolution 5A is arranged on a center axis E of the terminal 12.

Figure 8:
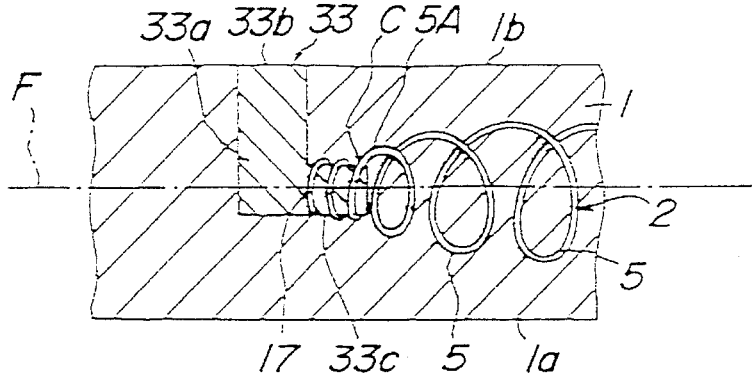
FIG. 8 is a cross sectional view illustrating a portion neighboring a terminal 33 of the ceramic heater according to one embodiment of the present invention.

FIG. 8 is a cross sectional view showing the first, second, third and fourth embodiments according to the invention. FIG. 8 is a cross sectional view illustrating a portion neighboring the resistance heating element 2 in which the resistance heating element 2 only is shown by a front view for convenience sake. In the ceramic heater shown in FIG. 8, use is made of a terminal 33 having a substantially L-shape cross section in FIG. 8. The terminal 33 comprises a main body 33*a*, and a post portion 33*c* extended perpendicularly to the main body 33*a*. An upper surface 33*b* of the main body 33*a* is exposed to the principal plane 1*b*.

In this embodiment, the post portion 33*c* is extended in a direction perpendicular to the thickness direction of the plate-like substrate 1. The resistance heating element 2 is formed by the convolution 5. A wounded conductive wire 17 is arranged around the post portion 33*c*.

In this embodiment, a dimension of the main body 33*a* viewed from the thickness direction of the plate-like substrate 1 is about a half of the thickness of the plate-like substrate 1. As a result, the post portion 33*c* is positioned at a center portion in the thickness direction of the plate-like substrate 1. Therefore, it is a matter of course that the wounded conductive wire 17 is connected to the terminal 33 at the center portion in the thickness direction of the plate-like substrate 1.

Consequently, a position of the connection portion between the terminal 33 and the resistance heating element 2 is not deviated during the sintering operation. Moreover, substantially no linear portion exists between the convolution 17 connected to the post portion 33*c* and the convolution 5 of the resistance heating element 2, and the wounded conductive wire 5A is arranged therebetween. That is to say, the convolution 5A is directly drawn from the position C of the connection portion between the terminal 33 and the conductive wire 17. Moreover, the convolution 5A is arranged on a center axis F of the post portion 33*c*. Therefore, even if the position C of the connection portion mentioned above is slightly deviated, the deviation can be absorbed by a deformation of the convolution 5A.

Figure 9:
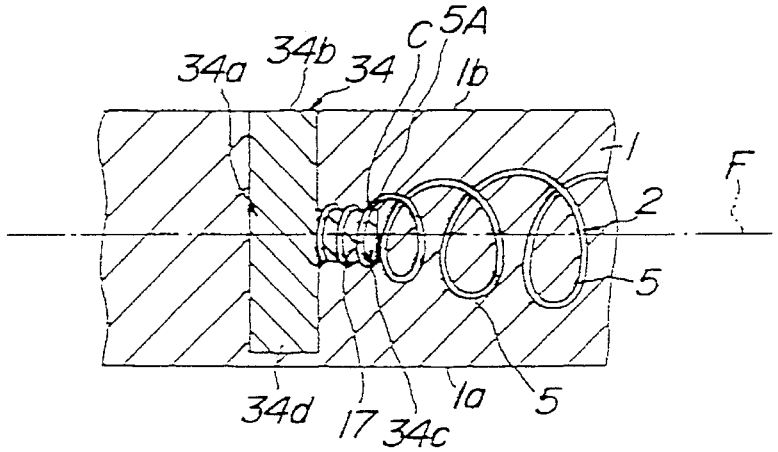
FIG. 9 is a cross sectional view showing a portion neighboring a terminal 34 of the ceramic heater according to one embodiment of the present invention.

FIG. 9 relates to the first, second, third and fourth embodiments according to the invention. In the ceramic heater shown in FIG. 9, use is made of a terminal 34 having a substantially T-shape cross section in FIG. 9. The terminal 34 comprises a main body 34*a*, a post portion 34*c* extended in a direction perpendicular to the main body 34*a*, and a portion 34*d* extended downwardly. An upper surface 34*b* of the main body 34*a* is exposed to a principal plane 1*b*.

In this embodiment, the post portion 34*c* is extended in a direction perpendicular to the thickness direction of the plate-like substrate 1. The resistance heating element 2 is formed by the convolution 5. A wounded conductive wire 17 is wound around the post portion 34*c*.

The post portion 34*c* is positioned at a substantially center portion in the thickness direction of the plate-like substrate 1. The wounded conductive wire 17 is connected to the terminal 34 at the center portion in the thickness direction of the plate-like substrate 1.

Substantially no linear portion exists between the convolution 17 connected to the post portion 34*c* and the convolution 5 of the resistance heating element 2, and the conductive wire 5A made of the convolution is arranged therebetween. That is to say, the convolution 5A is directly drawn from the position C of the connection portion between the terminal 34 and the conductive wire 17. Moreover, the convolution 5A is arranged on a center axis F of the post portion 34*c*. Therefore, even if the position C of the connection portion mentioned above is slightly deviated, the deviation can be absorbed by a deformation of the convolution 5A.

Figure 10:
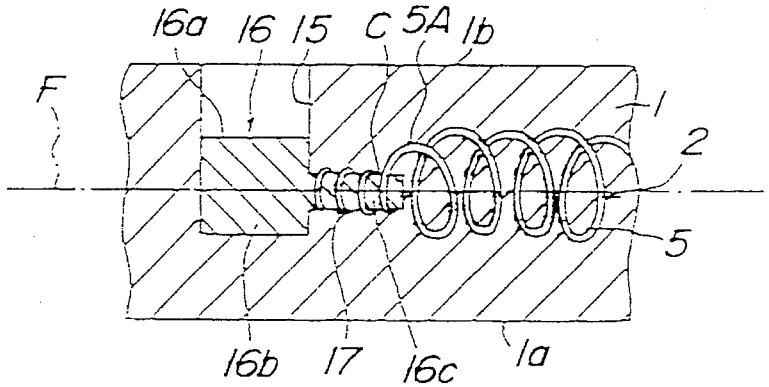
FIG. 10 is a cross sectional view illustrating a portion neighboring a terminal 16 of the ceramic heater according to one embodiment of the present invention.

FIG. 10 relates to the first, second, third and fourth embodiments of the invention. In the ceramic heater shown in FIG. 10, a terminal 16 comprises a main body 16*b* and a post portion 16*c*. An upper surface 16*a* of the main body 16*b* is exposed to the principal plane 1*b*. However, in this embodiment, the main body 16*b* is embedded in a hole 15, and thus the upper surface 16*a* is positioned at a concave portion with respect to the principal plane 1*b*. The post portion 16*c* is extended in a direction perpendicular to the thickness direction of the plate-like substrate 1.

In this embodiment, the post portion 16*c* is positioned at the center portion in the thickness direction of the plate-like substrate 1. The wound conductive wire 17 is connected to the terminal 16 at the center portion of the thickness direction of the plate-like substrate 1. Substantially no linear portion exists between the convolution 17 connected to the post portion 16*c* and the convolution 5 of the resistance heating element 2, and the conductive wire 5A made of the convolution is arranged therebetween. That is to say, the convolution 5A is directly drawn from the position C of the connection portion between the terminal 16 and the conductive wire 17. Moreover, the convolution 5A is arranged on the center axis F of the terminal 16.

Figure 11:
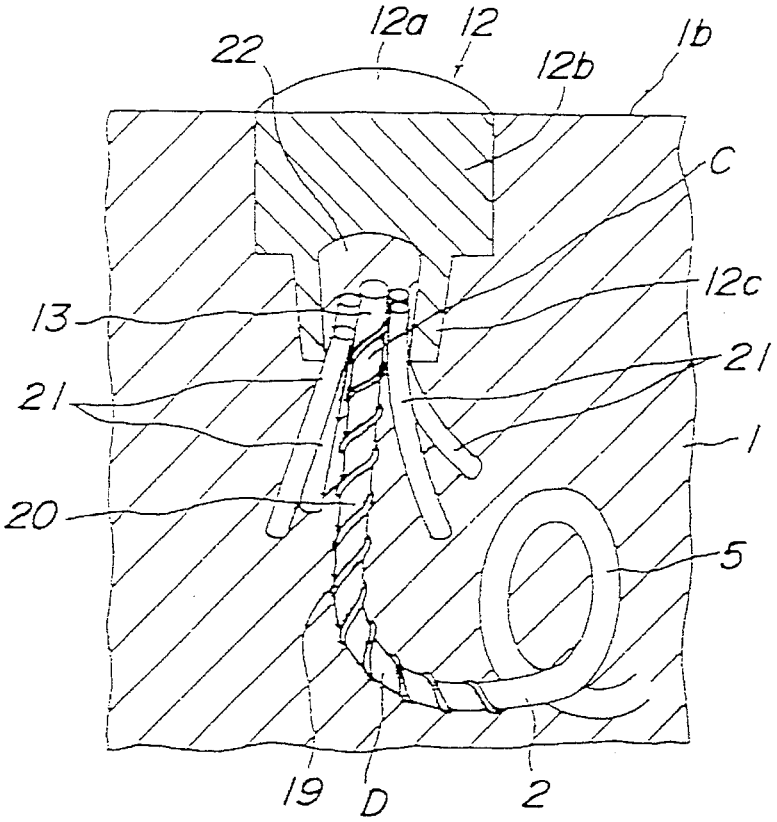
FIG. 11 is a cross sectional view showing one embodiment in which a pressure reduction member 21 is accommodated in a cylindrical projection portion 12*c* of the terminal 12 and a metal wire 19 is wound around a conductive wire 20.

FIG. 11 shows the fifth embodiment according to the invention. In the ceramic heater shown in FIG. 11, the resistance heating element 2 and the terminal 12 are embedded in the plate-like substrate 1. A conductive wire 20 is continued to the end portion of the convolution 5, and the end portion 13 of the conductive wire 20 is inserted in the cylindrical projection portion 12*c* of the terminal 12. The cylindrical projection portion 12*c* is deformed by caulking, and the end portion 13 is fixed in the inner portion 22 of the cylindrical projection portion 12*c*.

The end portion 13 of the conductive wire is continued to the linear portion 20, and the linear portion 20 is continued to the convolution 5. With respect to the linear conductive wire 20 arranged between the convolution 5 at the end of the resistance heating element and the connection portion C of the terminal 12, a thin metal wire 19 having a diameter smaller than that of the conductive wire 20 is wound therearound. Therefore, even if the position C of the connection portion mentioned above is deviated, a tensile pressure can be reduced by an elasticity of the metal wire 19. Moreover, even if the conductive wire 20 is broken, the metal wire 19 is not broken, thereby maintaining a current flow through the metal wire 19.

Further, pressure reduction members 21 formed by a wire member, a plate member a foil member, each made of a metal, are arranged to cover a portion neighboring the connection portion C between the conductive wire 20 and the terminal 12. An upper end portion of the pressure reduction member 21 is inserted in the cylindrical projection portion 12*c* and is fixed by the caulking as shown in FIG. 11. A lower end portion of the pressure reduction member 21 is extended around the linear conductive wire 20.

In the sintering operation, the ceramic powder flow and the generation of the pressure can be limited and reduced at a portion near the connection portion between the conductive wire 20 and the terminal 2. As for a material of the metal wire 19, it is preferred to use a metal having a high melting point such as tungsten, molybdenum, platinum, nickel or the like or the alloy thereof.

Moreover, in FIG. 11, a length of the pressure reduction member 21 may be shortened. Further, in FIG. 11, a shape of the pressure reduction member 21 may be a cone shape.

Figure 12:
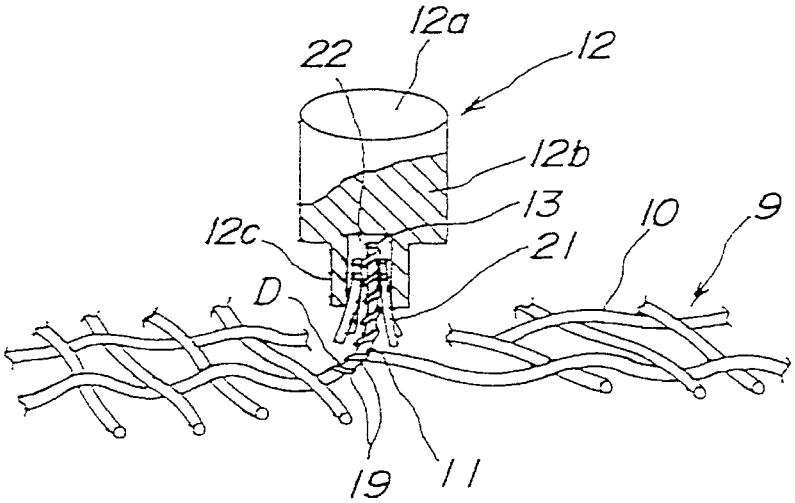
FIG. 12 is a perspective view with a cross section illustrating a connection portion between the terminal 12 and the net electrode 9 in the electrode device for generating a plasma.

FIG. 12 shows an embodiment in which the connection constitution illustrated in FIG. 11 is adapted to the connection between the wire net electrode 9 and the terminal 12. One of the metal wires 19 constituting the wire net electrode 9 is drawn, and the drawn conductive wire 11 is inserted in the inner portion 22 of the cylindrical projection portion 12*c* of the terminal 2 and is fixed. The other constructions such as the pressure reduction member 21 and the metal wire 19 are the same as those in FIG. 11.

Figure 13:
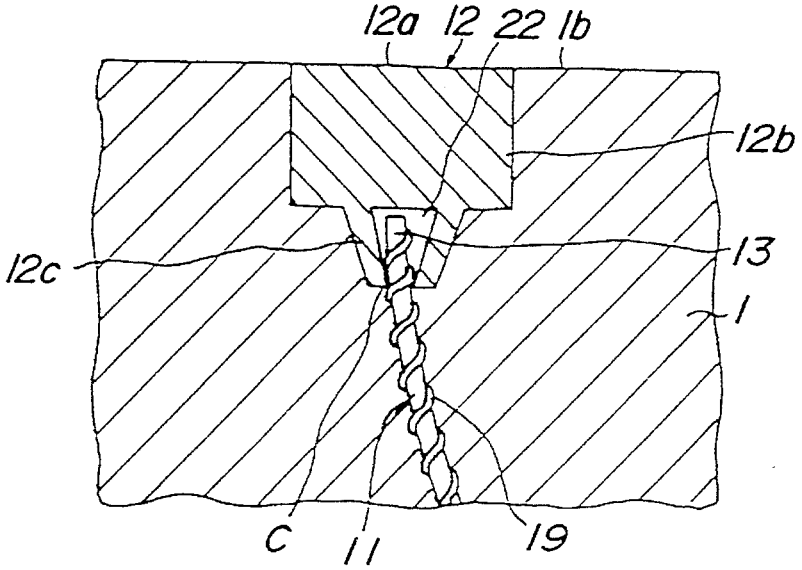
FIG. 13 is a cross sectional view showing one embodiment in which the metal wire 19 is wound around a conductive wire 11.

FIG. 13 shows the fifth embodiment according to the invention. In the ceramic heater shown in FIG. 13, the conductive wire 11 is linear, and the conductive wire 11 is continued to the convolution not shown. With respect to the linear conductive wire 11 and the conductive wire 13 in the cylindrical projection portion, the thin metal wire 19 having a diameter smaller than these diameters is wound.

Figure 14A:
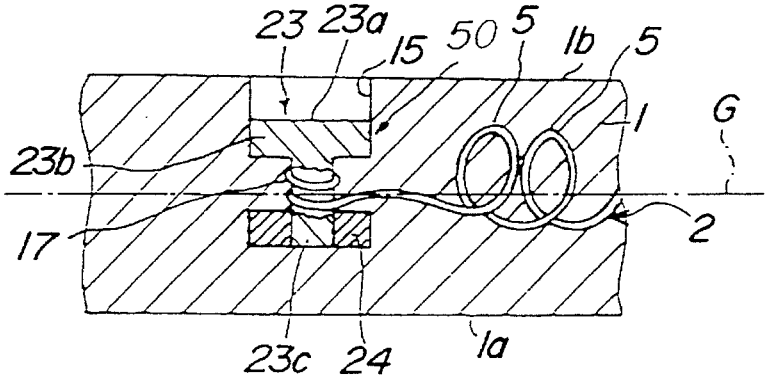
FIG. 14*a* is a cross sectional view illustrating a portion neighboring a terminal 22 of the ceramic heater according to one embodiment of the present invention.
Figure 14B:
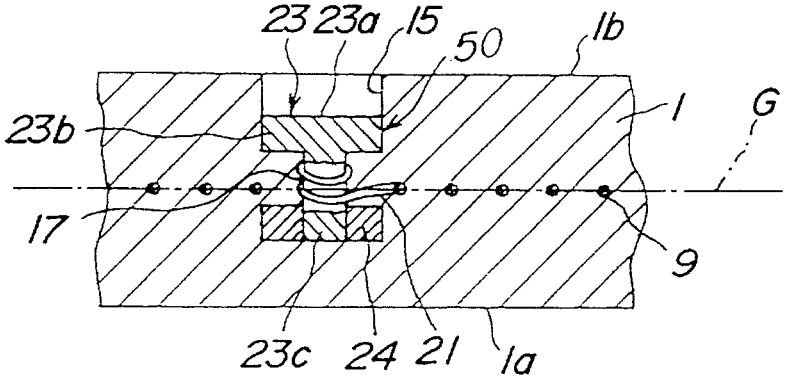
FIG. 14*b* is a cross sectional view showing a portion neighboring the terminal 22 of the electrode device for generating a plasma.

FIGS. 14*a* and 14*b* relate to the fourth and the seventh embodiments according to the invention. In the ceramic heater shown in FIG. 14*a*, a terminal 50 is embedded in the plate-like substrate 1. The terminal 50 has a bolt portion 23 and a nut portion 24. The bolt portion 23 has a top portion 23*b* and the male screw portion 23*c*. The male screw portion 23*c* is fitted with respect to an internal thread of the nut portion 24 to form the terminal 50. The top portion 23*b* is embedded in the worked hole 15. An upper surface 23*a* of the top portion 23*b* is positioned in a concave portion viewed from the rear surface 1*b*.

The resistance heating element 2 is formed by the convolution 5. The conductive wire 21 continued to an end portion of the convolution 5 is wound with respect to the male screw portion 23*c*, thereby fixing the convolution. The male screw portion 23*c* is positioned at the center portion G in the thickness direction of the plate-like substrate 1. The conductive wire 21 is connected to the terminal 50 at the center portion in the thickness direction of the plate-like substrate 1.

Also in the ceramic filter mentioned above, the same effects as those of previous embodiment can be obtained. Further, since the nut portion 24 is connected to the bolt portion 23 and is embedded in the substrate, there is no fear that the terminal 21 comes out of the worked hole 15 outwardly.

FIG. 14*b* shows the same connection construction as that of FIG. 14*a*, but the terminal 50 is connected to the wire net electrode 9 via the conductive wire 21. In FIG. 14*b*, only the portion neighboring the conductive wire 17 is shown by a front view, and the other portions are illustrated by a cross sectional view.

Figure 15:
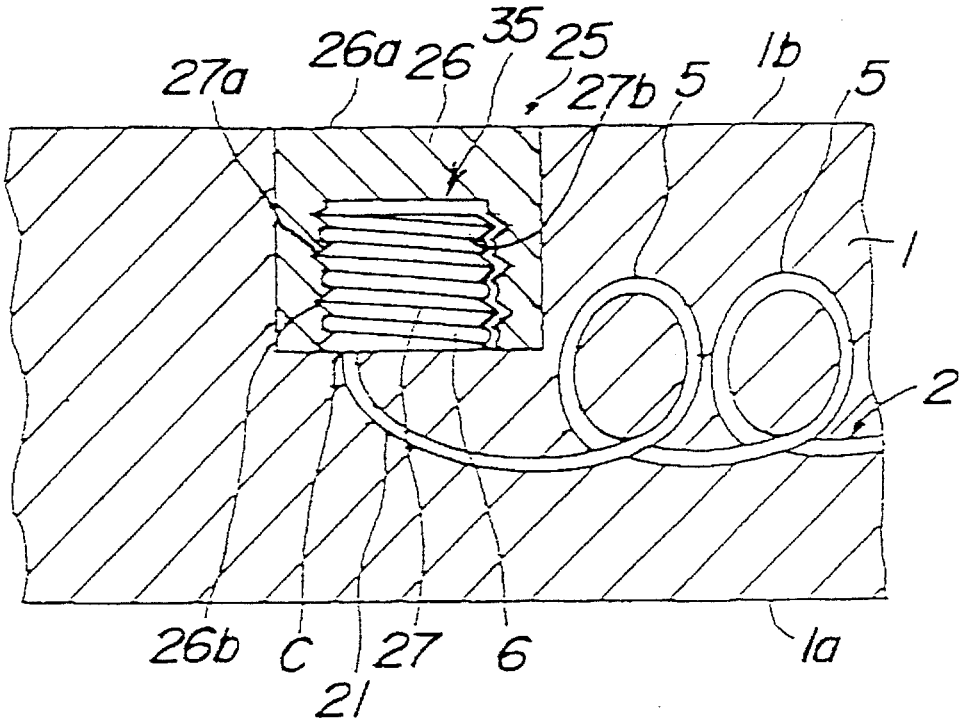
FIG. 15 is a cross sectional view illustrating a portion neighboring a terminal 25 of the ceramic heater according to one embodiment of the present invention.

FIG. 15 relates to the fourth, sixth and seventh embodiments according to the invention. In the ceramic heater shown in FIG. 15, a terminal 25 is embedded in the plate-like substrate 1. The terminal 25 has a securing member 26 and a winding member 35. An upper surface 26*a* of the securing member 26 is exposed to the rear surface 1*b*. In a lower portion of the securing member 26, an internal thread 26*b* is arranged. The winding member 35 has a substantially circular shape, and a male screw 27 is formed on an outer surface of the winding member 35. In this embodiment, a numeral 27*a* is a top portion of the male screw 27, and a numeral 27*b* is a root portion of the male screw 27.

The resistance heating element 2 is formed by the convolution 5. An end portion of the convolution 5 is continued to the conductive wire 21. An end portion of the conductive wire 21 is wound with respect to the male screw 27. In this case, a winding direction of the convolution 6 of the conductive wire 21 is the same as that of the male screw 27. The conductive wire 6 is fitted with respect to the root portion 27*b*, and the conductive wire 6 is fastened as mentioned above. After that, if necessary, the securing member 26 may be fitted with respect to the male screw 27.

Also in the ceramic heater according to the present embodiment, the same effect as that of the previous embodiment can be obtained. Moreover, in the case of fitting the securing member 26 with respect to the male screw 27, since the resistance heating element 2 is fixed in the terminal 25 stably, there is no fear that the resistance heating element 2 is come out of the terminal 25.

In the ceramic heater shown in FIG. 15, since a dimension of the terminal 25 in the thickness direction of the plate-like substrate 1 is relatively large, a lower end portion of the terminal 25 reaches to a substantially center portion in the thickness direction of the substrate 1. Therefore, since a connection fix portion C between the resistance heating element 2 and the terminal 25 is positioned at a substantially center portion in the thickness direction of the plate-like substrate 1, the connection portion is not so deviated during the sintering operation.

In FIGS. 2 to 15, the resistance heating element, the metal wire, the pressure reduction member or the like are shown by a front view or a perspective view other than a cross sectional view for a convenience sake.

Then, experimental results will be explained. The ceramic heaters according to respective embodiments shown in FIGS. 2, 7*a*, 7*b*, 8, 9, 10, 11, 13, 14*a* and 15 were manufactured. Moreover, the ceramic heater according to the comparative example shown in FIG. 1 was manufactured. In respective embodiments and the comparative example the resistance heating element was formed by a wire member made of tungsten. A diameter of the wire member was 0.5 mm, and a curvature diameter of the spirally-coiled convolution was 5 mm. The wire member was drawn to have a predetermined heat generating ratio, and then was subjected to a heat treatment at 1000° C. in a vacuum atmosphere. Moreover, in the embodiment shown in FIG. 11, a dimension of the wire member was that a diameter is 0.4 mmϕ and a length is 10 mm, and a dimension of the metal wire 19 was that a diameter is 0.1 mmϕ and a length is 60 mm.

The terminals of respective embodiments were connected to both ends of the resistance heating element according to respective embodiments. The calcined silicon nitride powders were charged in the press-molding machine, and were subjected to a pre-forming to have some extent of the hardness. In this case, a continuous concave portion was formed along a predetermined planar pattern on a surface of the pre-formed body.

The resistance heating element and the terminal of respective embodiments were accommodated in the concave portion, and further the silicon nitride powders were charged thereon. A uniaxial pressure was applied to the silicon nitride powders by a metal mold press to form a disc-shaped forming body. The disc-shaped forming body was subjected to a hot-press sintering at 1800° C. in a nitrogen atmosphere. The thus obtained sintered body was subjected to a cylindrical grinding, a plane grinding, a ultrasonic working and an arc working to obtain the ceramic heater having a diameter of 8 inches.

The terminal of respective embodiments was connected to a cable for the power supply. An alternate voltage of 200 V was supplied through the cable, and an average temperature on the principal plane 1*a* of the substrate 1 was elevated to 800° C. Temperature at respective points on the principal plane 1*a* were measured by an infrared radiation thermometer, and a temperature difference between the uppermost temperature and the lowermost temperature was calculated. The results were shown in Table 1.

TABLE 1

| Construction of ceramic heater | Temperature difference (°C.) |
|---|---|
| FIG. 2 | 10 |
| FIG. 7(a) | 30 |
| FIG. 7(b) | 40 |
| FIG. 8 | 30 |
| FIG. 9 | 30 |
| FIG. 10 | 20 |
| FIG. 11 | 18 |
| FIG. 13 | 25 |
| FIG. 14(a) | 30 |
| FIG. 15 | 15 |
| FIG. 1 | 50 |

As can be clearly understood from the table 1, in the ceramic heater according to the comparative example (FIG. 1), the temperature difference of 50° C. was detected, but, in the embodiments according to the invention, the temperature difference was largely improved. Especially, it is understood that the embodiments shown in FIGS. 2, 7, 8, 9, 10, 11, 13, 14*a* and 15 are preferred, the embodiments shown in FIGS. 2, and 15 are more preferred, and the embodiment shown in FIG. 2 is most preferred.

In the descriptions mentioned above, the present invention was explained by the preferred embodiments. However, it should be noted that the present invention is not limited to the embodiments mentioned above, but various modifications within the scope of the invention are possible.

What is claimed is:

1. A ceramic article comprising:

a monolithic, substantially planar ceramic substrate having a functional member integrally molded therewith and embedded therein;

a terminal extending from one surface of said substrate into an interior thereof; and a conductive wire embedded in said substrate and providing electrical communication between said functional member and said terminal, wherein a portion of said conductive wire extending from said functional member to a connection point with said terminal is curved.

2. The ceramic article of claim 1, wherein the entirety of said conductive wire extending from said functional member to said connection point is continuously curved.

3. The ceramic article of claim 1, wherein said terminal is integrally molded with and embedded in said substrate.

4. A ceramic article comprising:

a monolithic, substantially planar ceramic substrate having a functional member integrally molded therewith and embedded therein;

a terminal extending from one surface of said substrate into an interior thereof; and a conductive wire embedded in said substrate and providing electrical communication between said functional member and said terminal, wherein a portion of said conductive wire extending from said functional member to a connection point with said terminal is curved, and said curved portion is substantially aligned with a central axis of said terminal.

5. The ceramic article of claim 4, wherein said conductive wire includes a linear portion fixed in said terminal and aligned with the central axis of said terminal.

6. The ceramic article of claim 4, wherein said terminal is integrally molded with and embedded in said substrate.

7. A ceramic article comprising:

a monolithic, substantially planar ceramic substrate having a functional member integrally molded therewith and embedded therein;

a terminal extending from one surface of said substrate into an interior thereof, said terminal having a post portion extending in a direction parallel to the surfaces of said planar substrate; and a conductive wire embedded in said substrate and providing electrical communication between said functional member and said terminal, wherein said conductive wire is wound around said post portion.

8. The ceramic article of claim 7, wherein said terminal is integrally molded with and embedded in said substrate.

9. A ceramic article comprising:

a monolithic, substantially planar ceramic substrate having a functional member integrally molded therewith and embedded therein;

a terminal extending from one surface of said planar substrate into an interior thereof; and a conductive wire embedded in said substrate and providing electrical communication between said functional member and said terminal, wherein said conductive wire is connected to said terminal at a portion thereof that is positioned centrally between opposed outer surfaces of said planar substrate.

10. The ceramic article of claim 9, wherein said terminal is integrally molded with and embedded in said substrate.

11. A ceramic article comprising:

a monolithic, substantially planar ceramic substrate having a functional member integrally molded therewith and embedded therein;

a terminal extending from one surface of said substrate into an interior thereof; and a conductive wire embedded in said substrate and providing electrical communication between said functional member and said terminal, wherein at least a portion of said conductive wire is connected to said terminal and that portion includes a metal member arranged therearound.

12. The ceramic article of claim 11, wherein said terminal is integrally molded with and embedded in said substrate.

13. A ceramic article comprising:

a monolithic, substantially planar ceramic substrate having a functional member integrally molded therewith and embedded therein;

a terminal extending from one surface of said substrate into an interior thereof, said terminal having a screw thread formed thereon; and a conductive wire embedded in said substrate and providing electrical communication between said functional member and said terminal, wherein said conductive wire is wound around said terminal in the root portion of said screw thread.

14. The ceramic article of claim 13, wherein said terminal is integrally molded with and embedded in said substrate.

15. A ceramic article comprising:

a monolithic, substantially planar ceramic substrate having a functional member integrally molded therewith and embedded therein;

a terminal extending from one surface of said substrate into an interior thereof, said terminal having a winding member with a male screw thread for winding a wire and a securing member for holding said winding member in said substrate; and a conductive wire embedded in said substrate and providing electrical communication between said functional member and said terminal, wherein said conductive wire is wound around said winding member.

16. The ceramic article of claim 15, wherein said terminal is integrally molded with and embedded in said substrate.

* * * * *